US011800924B2

(12) United States Patent
Hohlbein et al.

(10) Patent No.: US 11,800,924 B2
(45) Date of Patent: Oct. 31, 2023

(54) ORAL CARE IMPLEMENT

(71) Applicant: Colgate-Palmolive Company, New York, NY (US)

(72) Inventors: Douglas Hohlbein, Hopewell, NJ (US); Daniel Wainless, New Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 62 days.

(21) Appl. No.: 16/701,776

(22) Filed: Dec. 3, 2019

(65) Prior Publication Data

US 2021/0161283 A1 Jun. 3, 2021

(51) Int. Cl.
*A46B 5/02* (2006.01)

(52) U.S. Cl.
CPC ..... *A46B 5/02* (2013.01); *A46B 2200/1066* (2013.01)

(58) Field of Classification Search
CPC ..... A45B 5/02; A45B 5/026; A45B 5/007; A45B 5/021; B29C 45/1676; A46B 2200/1066
USPC ..... 15/167.1, 143.1
See application file for complete search history.

(56) References Cited

U.S. PATENT DOCUMENTS 2,229,664 A * 1/1941 Meeske ..... A46B 15/0085 15/167.1
D416,685 S * 11/1999 Overthun ..... D4/104
6,546,585 B1 * 4/2003 Blaustein ..... A46B 7/04 15/176.1
6,851,882 B1 2/2005 Maloney
7,383,619 B2 6/2008 Gross et al.
7,836,539 B2 11/2010 Moskovich et al.
(Continued)

FOREIGN PATENT DOCUMENTS

CN 201920008 8/2011
EP 0580406 1/1994
(Continued)

OTHER PUBLICATIONS

Ecovona (https://www.amazon.com/Ecovona-Toothbrush-BPA-Free-Teething Toothpaste/dp/B07NV1V84X, retrieved Nov. 21, 2019, pp. 1-6, as cited in Applicant's IDS dated Dec. 3, 2019) (Year: 2019).*
(Continued)

*Primary Examiner* — Brian D Keller
*Assistant Examiner* — Robert C Moore

(57) ABSTRACT

An oral care implement having a head and a handle. A plurality of tooth cleaning elements extend from an exposed front surface of the head. The handle has an open thumb gripping passageway extending between an exposed first surface of the handle and an exposed second surface of the handle opposite the exposed first surface. The handle also has a plurality of slots defining open slot passageways from the exposed first surface of the handle to the exposed second surface of the handle. The open thumb gripping passageway may be defined by a ring component that is fitted into an aperture in a body component. The open thumb gripping passageway may be a void space in the handle. The open slot passageways may be elongated along the handle and may serve to reduce a total amount of virgin material needed to manufacture the oral care implement.

9 Claims, 13 Drawing Sheets

(56) References Cited

U.S. PATENT DOCUMENTS

| | | | | |
|---|---|---|---|---|
| 7,937,794 | B2 * | 5/2011 | Huber | A46D 1/00 15/167.1 |
| D670,504 | S * | 11/2012 | Watanabe | D4/104 |
| 9,498,240 | B1 * | 11/2016 | Godley | A61B 17/244 |
| 9,510,664 | B2 | 12/2016 | Wen et al. | |
| 9,731,427 | B2 * | 8/2017 | Gratsias | B26B 21/521 |
| D851,411 | S | 6/2019 | Wainless et al. | |
| 2005/0044647 | A1 * | 3/2005 | Hohlbein | A46B 5/02 15/167.1 |
| 2009/0188063 | A1 * | 7/2009 | Baertschi | A46B 5/02 15/167.1 |
| 2014/0173853 | A1 | 6/2014 | Kirchhofer et al. | |
| 2015/0313350 | A1 | 11/2015 | Hohlbein | |
| 2017/0347781 | A1 * | 12/2017 | Jimenez | A46B 9/04 |
| 2019/0313779 | A1 | 10/2019 | Hohlbein et al. | |
| 2022/0408907 | A1 * | 12/2022 | Zwimpfer | B25G 3/12 |

FOREIGN PATENT DOCUMENTS

| | | |
|---|---|---|
| WO | 1997/10938 | 3/1997 |
| WO | 2011/075133 | 6/2011 |
| WO | 2013/078360 | 5/2013 |
| WO | 2014/153747 | 10/2014 |

OTHER PUBLICATIONS

Amazon website, https://www.amazon.com/Ecovona-Toothbrush-BPA-Free-Teething-Toothpaste/dp/B07NV1V84X, retrieved Nov. 21, 2019, pp. 1-6.

Cook's Illustrated website, https://www.cooksillustrated.com/articles/1508-testing-bottle-brushes, retrieved Nov. 21, 2019, pp. 1-8.

Electric Teeth website, https://www.electricteeth.com/best-baby-toothbrush/, retrieved Nov. 21, 2019, pp. 1-39.

Global Rakuten website, https://global.rakuten.com/en/store/iihada/item/0512/, retrieved Nov. 21, 2019, pp. 1-8.

Kapemvun, Sophia (May 7, 2019), "3 Homemade Garden Sprays You Can't Do Without," http://kapemvun.info/3-homemade-garden-sprays-you-cant-do-without/, retrieved Nov. 21, 2019, pp. 1-6.

Riteaid website, https://www.riteaid.com/shop/oral-b-pro-health-clinical-pro-flex-toothbrushes-soft-s-value-pack-2-toothbrushes-0349017, retrieved Nov. 21, 2019, pp. 1-5.

Star Solutions website, https://starsolutions.vn/en/hotel-amenities/toothbrush-bc-63/, retrieved Nov. 21, 2019, pp. 1-6.

* cited by examiner

ORAL CARE IMPLEMENT

BACKGROUND

Toothbrushes and other oral care products are typically manufactured out of plastic. Toothbrushes are only intended to be used for approximately three months, after which they are discarded. Because basically everyone uses a toothbrush, this adds a large amount of plastic to our landfills and oceans Plastic is a material that is made to last forever. As a result, plastic cannot biodegrade and instead breaks down into smaller and smaller pieces over time. As plastic sits in landfills, toxic chemicals that are harmful to humans and animals leach out. There is a current trend in many industries to move away from plastic as a material for product manufacture or to reduce the amount of plastic that is used to manufacture the product. Thus, there is a continuing need to find alternative techniques for reducing the amount of plastic used in the manufacture of toothbrushes and other oral care implements and/or personal care implements.

BRIEF SUMMARY

The present invention may be directed to an oral care implement having a head and a handle. A plurality of tooth cleaning elements extend from an exposed front surface of the head. The handle has an open thumb gripping passageway extending between an exposed first surface of the handle and an exposed second surface of the handle opposite the exposed first surface. The handle also has a plurality of slots defining open slot passageways from the exposed first surface of the handle to the exposed second surface of the handle. The open thumb gripping passageway may be defined by an elastomeric ring portion that is fitted into an aperture in a rigid base component. The open thumb gripping passageway may be a void space in the handle. The open slot passageways may be elongated along the handle and may serve to reduce a total amount of virgin material needed to manufacture the oral care implement.

In one aspect, the invention may be an oral care implement comprising: a head; a plurality of tooth cleaning elements extending from an exposed front surface of the head; a handle extending along a longitudinal axis from a proximal end to a distal end, the head coupled to the distal end of the handle, the handle comprising: a neck region comprising the distal end; and a palm gripping region comprising the proximal end, the palm gripping region comprising: a plurality of elongated longitudinal slots defining open slot passageways from an exposed front surface of the handle to an exposed rear surface of the handle; and a plurality of longitudinal beams, wherein adjacent ones of the longitudinal beams are separated by one of the plurality of elongated longitudinal slots, each of the longitudinal beams having a transverse cross-section comprising: (1) a maximum height, measured along a height axis extending from the exposed front surface of the handle to the exposed rear surface of the handle; and (2) a maximum width, measured along a width axis that is perpendicular to the height axis, the maximum height being greater than the maximum width.

In another aspect, the invention may be an oral care implement comprising: a head; a plurality of tooth cleaning elements extending from an exposed front surface of the head; a handle formed of one or more materials having a material volume and comprising a plurality of voids collectively defining a void volume; and wherein a ratio of the void volume to the material volume is greater than or equal to 0.25:1.0.

In yet another aspect, the invention may be an oral care implement comprising: a handle extending along a longitudinal axis from a proximal end to a distal end, the handle having a length measured from the proximal end to the distal end and a palm gripping region extending from the proximal end to a midpoint along the length, the palm gripping region comprising: a left-side longitudinal beam comprising a portion of an exposed left-side surface of the handle, a right-side longitudinal beam comprising a portion of an exposed right-side surface of the handle, and at least one middle longitudinal beam disposed between the left-side and right-side longitudinal beams; and a first elongated slot defining a first open slot passageway from an exposed front surface of the handle to an exposed rear surface of the handle, the first elongated slot located between the left-side longitudinal beam and the middle longitudinal beam; and a second elongated slot defining a second open slot passageway from the exposed front surface of the handle to the exposed rear surface of the handle, the second elongated slot located between the right-side longitudinal beam and the middle longitudinal beam.

In a further aspect, the invention may be an oral care implement comprising: a head; a plurality of tooth cleaning elements extending from an exposed front surface of the head; a handle extending along a longitudinal axis from a proximal end to a distal end, the head coupled to the distal end of the handle, the handle comprising: a neck region comprising the distal end; a palm gripping region comprising the proximal end; and a thumb gripping region located between the neck and palm gripping regions, the thumb gripping region comprising a ring portion of a body component formed of a first material, a ring component formed of a second material coupled to the ring portion of the body component, and an open thumb gripping passageway extending from an exposed front surface of the handle to an exposed rear surface of the handle; and wherein the ring component and the body component of the thumb gripping region both form portions of an exposed outer surface of the handle; and wherein the first and second materials are different from one another in at least one characteristic selected from color, texture, and rigidity.

In a still further aspect, the invention may be an oral care implement comprising: a handle comprising: a body component formed of a first material, the body component comprising: a neck region; a palm gripping region; and a thumb gripping region located between the neck and palm gripping regions, the body component comprising an aperture along the thumb gripping region that extends from an opening in a front surface of the body component of the handle to an opening in a rear surface of the body component of the handle; and a ring component formed of a second material and coupled to the body component, the ring component comprising: an annular wall portion located within the aperture of the body component, the annular wall portion having an inner surface that defines an open thumb gripping passageway that extends from an exposed front surface of the handle to an exposed rear surface of the handle; and a front annular flange covering a first portion of the front surface of the body component and protruding from an exposed portion of the front surface of the body component.

In yet another aspect, the invention may be an oral care implement comprising: a head; a plurality of tooth cleaning elements extending from an exposed front surface of the head; and a handle comprising: an open thumb gripping passageway extending between an exposed first surface of the handle and an exposed second surface of the handle opposite the exposed first surface; and a plurality of slots defining open slot passageways from the exposed first surface of the handle to the exposed second surface of the handle, first and second slots of the plurality of slots separated from one another by a middle longitudinal beam that forms a continuous and uninterrupted portion of the exposed first surface of the handle and a continuous and uninterrupted portion of the exposed second surface of the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
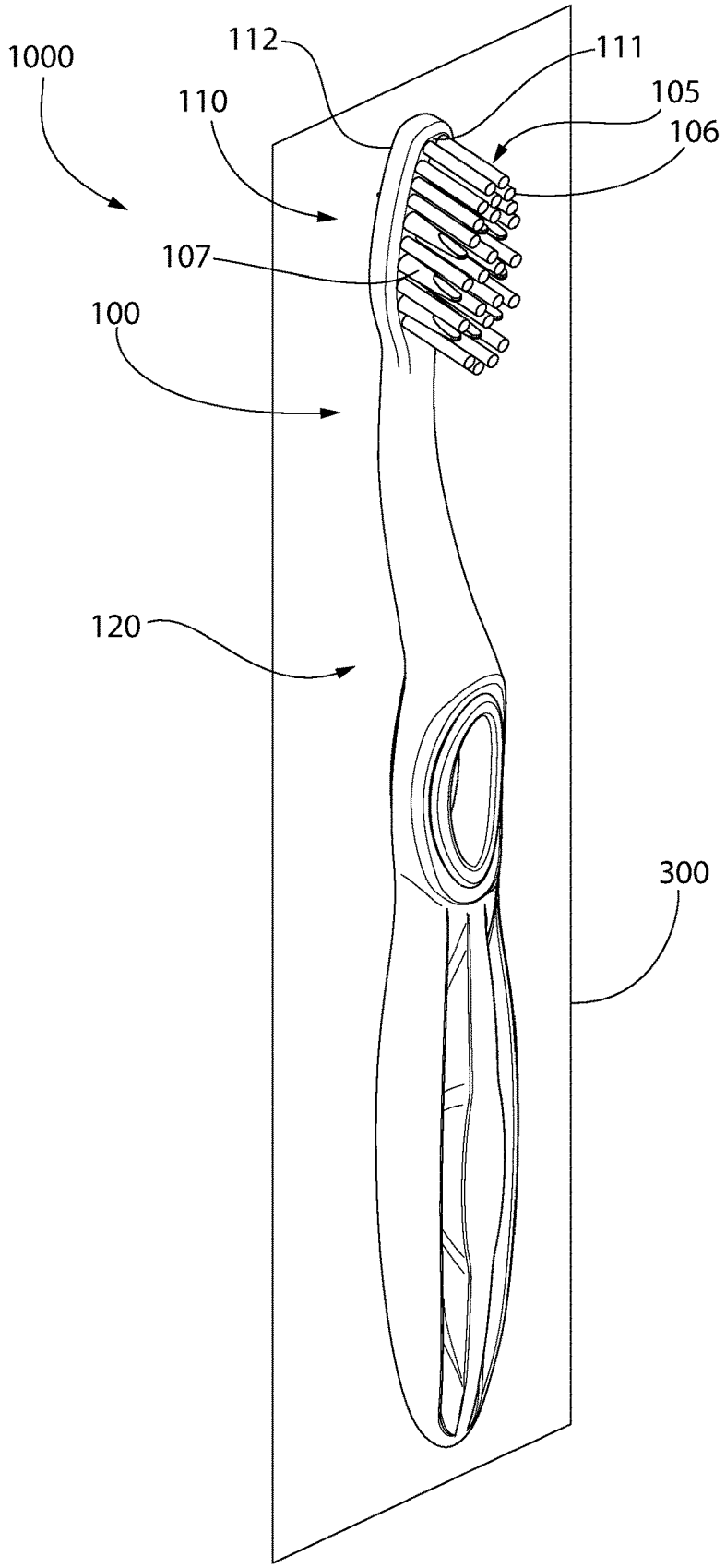
FIG. 1 is a perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-4 concurrently, an oral care implement 100 will be described in accordance with an embodiment of the present invention. In the exemplified embodiment, the oral care implement 100 is a manual toothbrush. However, the invention is not to be so limited in all embodiments and the oral care implement 100 can take on other structural forms, including being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Furthermore, in still other embodiments the implement may not be specifically used for oral care, but could instead be a personal care implement which includes the various types of oral care implements noted herein and also includes hairbrushes, razors, body scrubbers, skin treatment devices, or the like. Thus, it is to be understood that the inventive concepts discussed herein can be applied to any type of oral care implement or personal care implement unless a specific type of implement is specified in the claims.

The oral care implement 100 generally comprises a head 110 and a handle 120. The handle 120 is an elongated structure that is gripped by a user during use of the oral care implement 100. Specifically, a user wraps his/her hand around the handle 120 to manipulate the oral care implement 100 during use in order to brush teeth or perform other operations with the oral care implement 100. The handle 120 of the oral care implement 100 has a specific design that results in a reduction in plastic material used to form the oral care implement 100 to address environmental concerns related to the use of plastic. Thus, the handle 120 has voids or recesses or slots, described in detail below, to facilitate this reduction in plastic material while having a design that ensures that the structural integrity of the oral care implement 100 is maintained.

The head 110 of the oral care implement 100 has an exposed front surface 111 and an exposed rear surface 112 opposite the exposed front surface 111. There are a plurality of tooth cleaning elements 105 extending from the exposed front surface 111 of the head 110. In the exemplified embodiment, the plurality of tooth cleaning elements 105 comprises a plurality of bristle tufts 106 and a plurality of elastomeric cleaning elements 107. The bristle tufts 106 and the elastomeric cleaning elements 107 collectively form a cleaning element field on the head 110. The particular arrangement and/or pattern and/or location of the various bristle tufts 106 and elastomeric cleaning elements 107 is not to be limiting of the present invention in all embodiments. Thus, the bristle tufts 106 and the elastomeric cleaning elements 107 could be positioned at locations other than that which is depicted in the drawings. Furthermore, in some embodiments the oral care implement 100 may include only bristle tufts 106 and none of the elastomeric cleaning elements 107. Thus, various permutations of the plurality of tooth cleaning elements 105 are possible within the scope of the invention described herein.

Furthermore, where it does not conflict with the other disclosure provided herein or the claims, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning element field in some embodiments. Furthermore, where bristles are used for one or more of the tooth cleaning elements 105, such bristles can be tapered, end-rounded, spiral, or the like.

In embodiments that use elastomeric materials to form one or more of the tooth cleaning elements 105, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 105 may be coupled to the head 110 in any manner known in the art, including staples, in-mold tufting (IMT), anchor-free tufting (AFT), or a modified AFT known as AMR. In the exemplified embodiment, the bristle tufts 106 are secured to the head using staples/anchors and the elastomeric cleaning elements 107 are secured to the head 110 via an injection molding process, as will be described further below with reference to FIGS. 5-7.

The handle 120 of the oral care implement 100 extends along a longitudinal axis A-A from a proximal end 121 to a distal end 122. The head 110 is coupled to the handle 120 at the distal end 122 of the handle 120. In the exemplified embodiment, the head 110 and the handle 120 are integrally formed as a unitary and monolithic structure. Thus, in the exemplified embodiment the head 110 is not detachable from the handle 120. However, in other embodiments the head 110 and the handle 120 may be separately formed and later coupled together. In some embodiments, the head 110 may be detachably coupled to the handle 120 such that the head 110 is a refill head that can be replaced upon deterioration of the tooth cleaning elements 105.

The handle 120 comprises a neck region 123 that comprises the distal end 122, a palm gripping region 124 that comprises the proximal end 121, and a thumb gripping region 125 located between the neck region 123 and the palm gripping region 124. The palm gripping region 124 is the region of the handle 120 that a user's palm and fingers (generally the pinky, ring finger, and middle finger) wraps around during normal use. The thumb gripping region 125 is the region that a user's thumb (and index/pointer finger) rests upon during use. The neck region 123 is the region that connects the handle 120 to the head 110.

More specifically, the handle 120 may have a length L measured from the proximal end 121 to the distal end 122. The palm gripping region 124 may be the region of the handle 120 extending from the proximal end 121 to a distance that is approximately one-half (i.e., between 40% and 60%) of the length L of the handle 120. The neck region 123 may be the region of the handle 120 extending from the distal end 122 to a distance that is approximately one-quarter (i.e., between 15% and 35%) of the length L of the handle 120. The thumb gripping region 125 is the remaining region of the handle 120 that is located between the neck region 123 and the palm gripping region 124. As used in relation to the various regions of the handle 120, the term approximately includes a distance/length that is plus or minus 10% from the measurement noted herein (thus, for example, the palm gripping region 124 may have a length that is between 40% and 60% of the length L, the neck region 123 may have a length that is between 15% and 35% of the length L, and the thumb gripping region 125 may be the remaining region of the handle 120).

Referring to FIGS. 2-5, in the exemplified embodiment the oral care implement 100 comprises a body component 101 and an elastomeric component 102. The body component 101 is formed of a hard plastic and the elastomeric component 102 is formed of an elastomeric material. The hard plastic may be, for example without limitation, polypropylene, polyethylene terephthalate, polyethylene, polystyrene, polyvinyl chloride, or the like in various different embodiments. The elastomeric material may be, for example without limitation, a thermoplastic elastomer, a thermoplastic polyurethane, rubber, silicone, or the like. In the exemplified embodiment, the body component 101 forms the entirety of the palm gripping region 124 of the handle 120 whereas the body component 101 and the elastomeric component 102 collectively form the neck region 123 and the thumb gripping region 125 of the handle 120 as well as the head 110.

The body component 101 comprises a head portion 180 and a handle portion 185. The head portion 180 of the body component 101 has a front surface 181 that forms the front surface 111 of the head 120 and a rear surface 182 that may form a portion of the rear surface 112 of the head 110. As will be discussed below, the elastomeric portion 102 may cover a portion of the rear surface 182 of the head portion 180 of the body component 101 to form a tongue or soft tissue cleaner of the oral care implement 100.

The elastomeric component 102 comprises an elastomeric ring portion 109, an elastomeric cleaning element portion 115, and an elastomeric connector portion 116 extending between the elastomeric ring portion 109 and the elastomeric cleaning element portion 115. In the exemplified embodiment, the elastomeric component 102 is an integral and monolithic component formed via a single shot injection molding technique (although multiple shots could be used in other embodiments to modify color, texture, softness, or the like of the elastomeric component 102). Thus, the elastomeric component 102 is formed as an integral mass of elastomeric material in the exemplified embodiment. In other embodiments, the various portions of the elastomeric component 102 could be formed as separate injection molding shots and they may be separated from one another. As will be discussed in greater detail below, the thumb gripping region 125 of the handle 120 comprises the elastomeric ring portion 109, the elastomeric cleaning element portion 115 is located on and/or forms a part of the head 110, and the elastomeric connector portion 116 extends along the neck region 123 to connect the elastomeric ring portion 109 to the elastomeric cleaning element portion 115.

Figure 5:
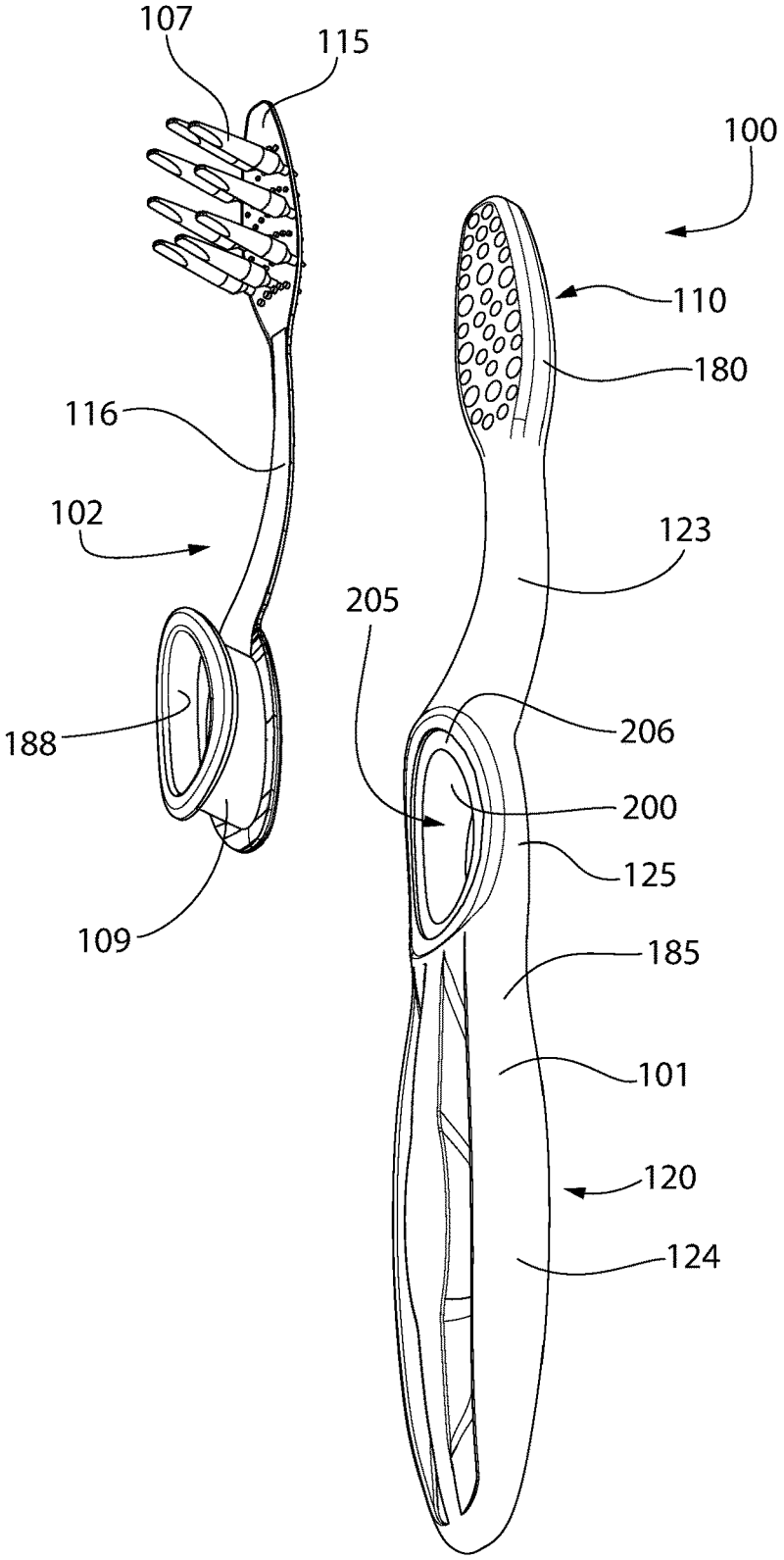
FIG. 5 is an exploded view of the oral care implement of FIG. 1.
Figure 6:
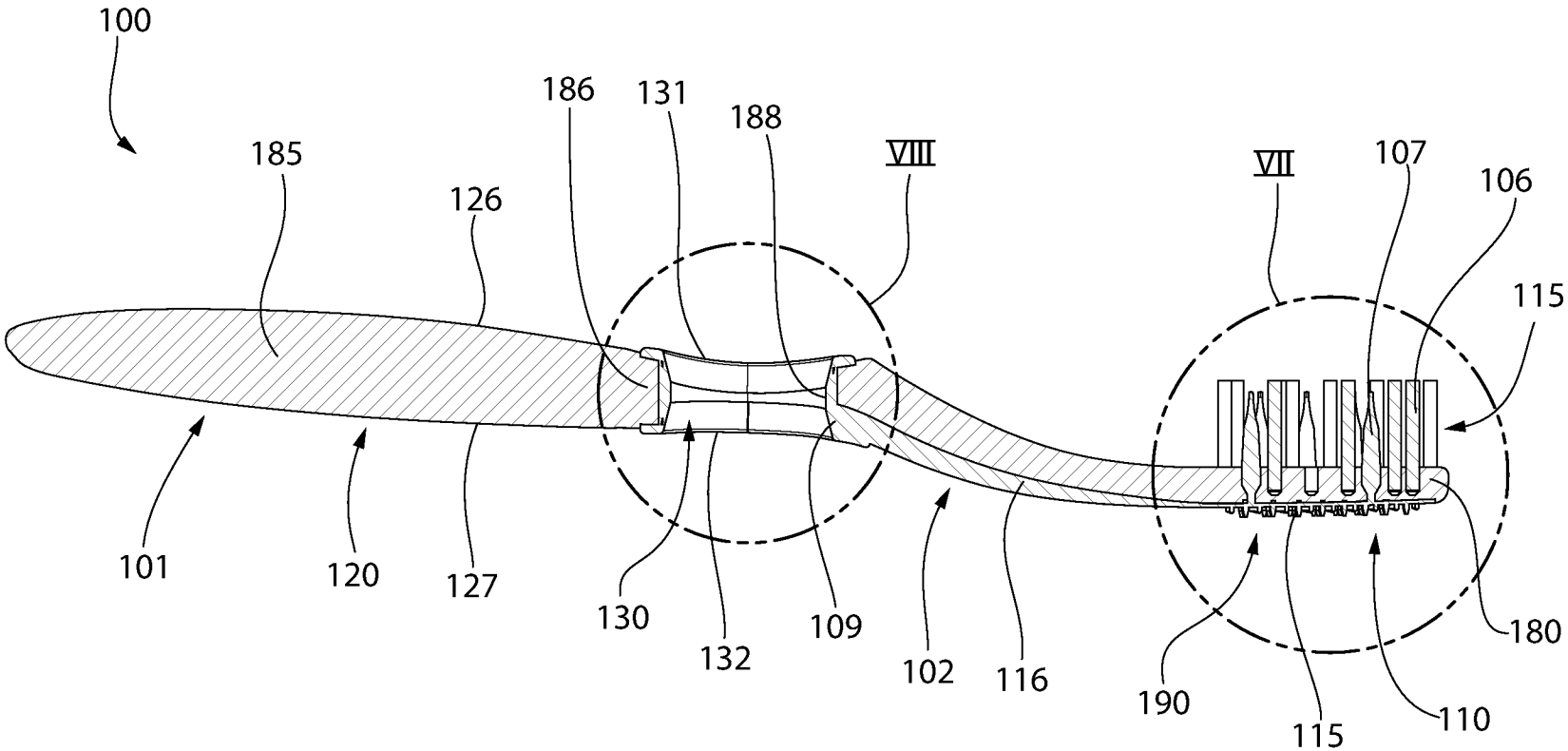
FIG. 6 is a cross-sectional view taken along line VI-VI of FIG. 2.
Figure 7:
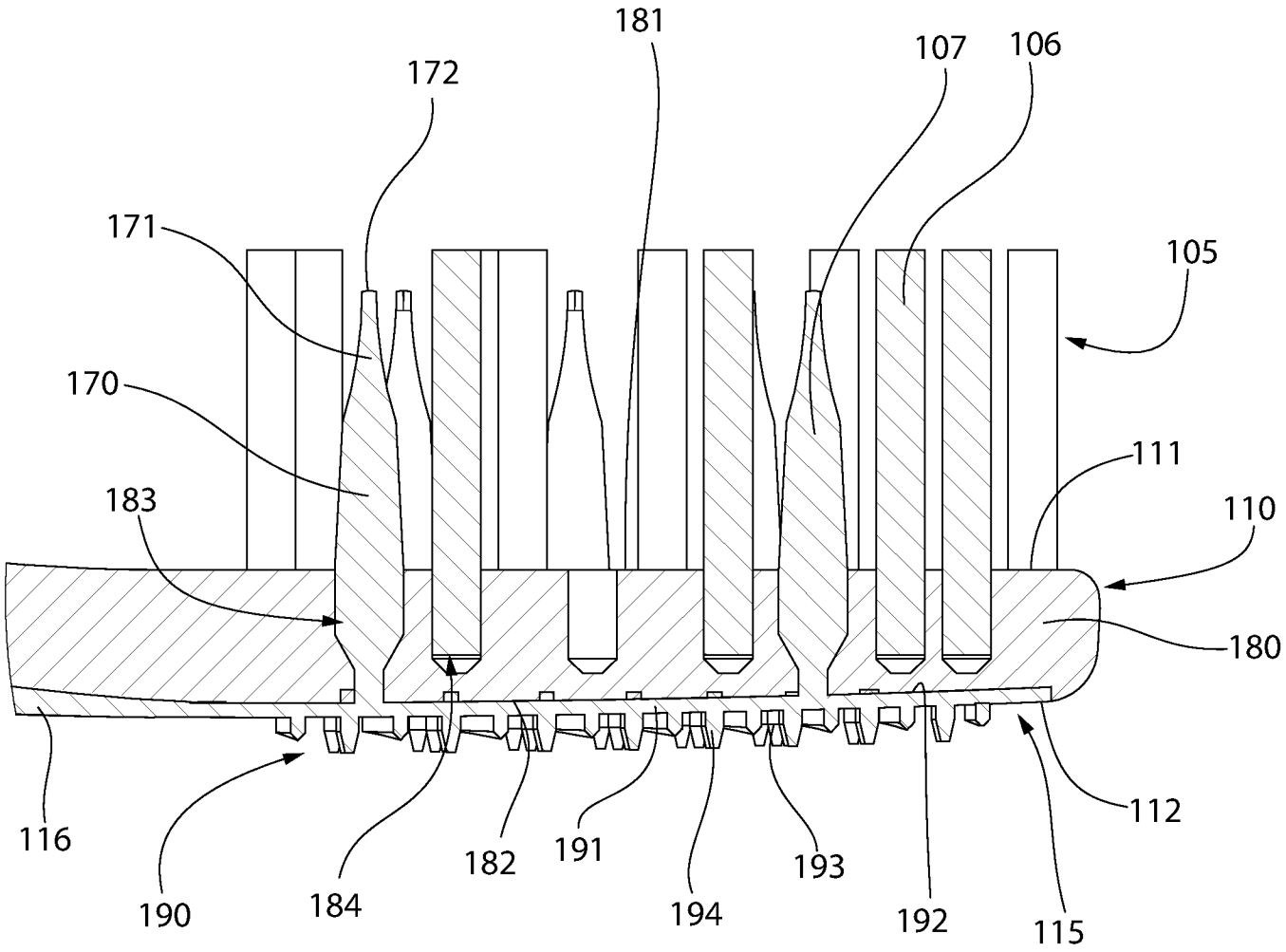
FIG. 7 is a close-up view of area VII of FIG. 6.

Referring to FIGS. 5-7, the elastomeric cleaning element portion 115 comprises a tongue cleaner 190 having a pad portion 191 having a front surface 192 and a rear surface 193, a plurality of tongue cleaning protrusions 194 extending from the rear surface 193 of the pad portion 191, and the plurality of elastomeric cleaning elements 107 extending from the front surface 192 of the pad portion 191. The pad portion 191 is located on the rear surface 182 of the head portion 180 of the body component 101. The rear surface 193 of the pad portion 191 forms at least a portion of the rear surface 112 of the head 110 (with the rear surface 182 of the head portion 180 of the body component 101 forming the rest of the rear surface 112 of the head 110 in embodiments where the rear surface 193 of the pad portion 191 does not form the entirety of the rear surface 112 of the head 110). In that regard, in the exemplified embodiment the head 110 is formed by the head portion 180 of the body component 101 and the elastomeric cleaning element portion 115 of the elastomeric component 102 which is coupled to the head portion 180 of the body component 101. The rear surface 193 of the pad portion 191 is disposed within a recess formed into the rear surface 182 of the head portion 180 of the body component 101 so that the rear surface 193 of the pad portion 191 is flush with the rear surface 182 of the head portion 180 in the exemplified embodiment.

Figure 3:
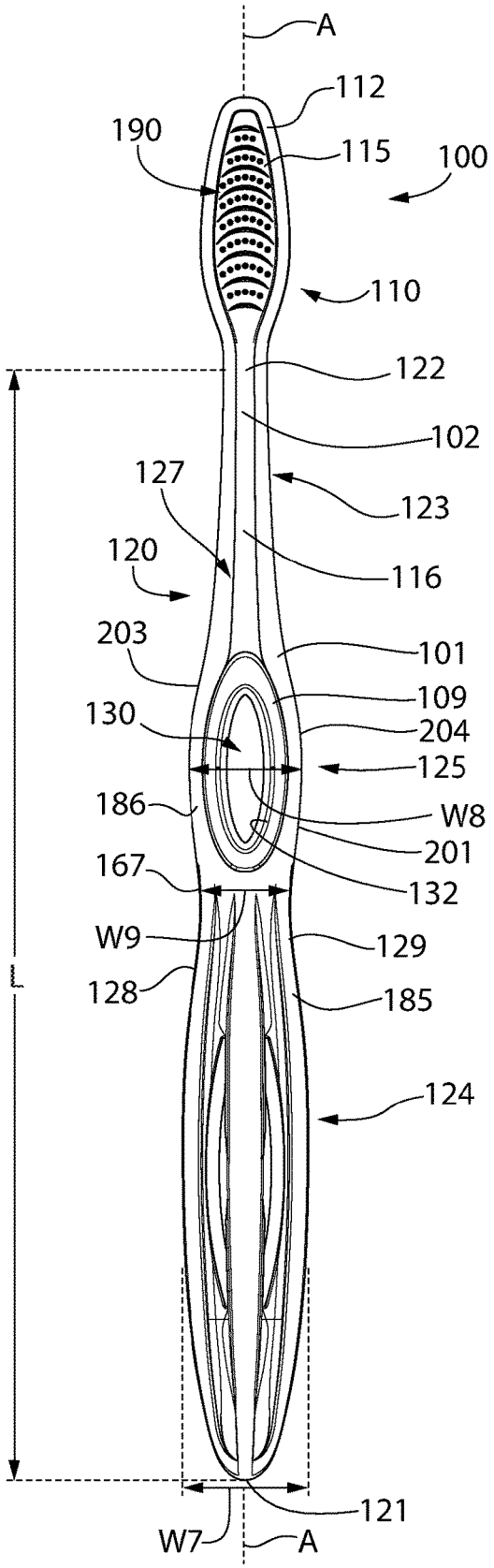
FIG. 3 is a rear view of the oral care implement of FIG. 1.
Figure 4:
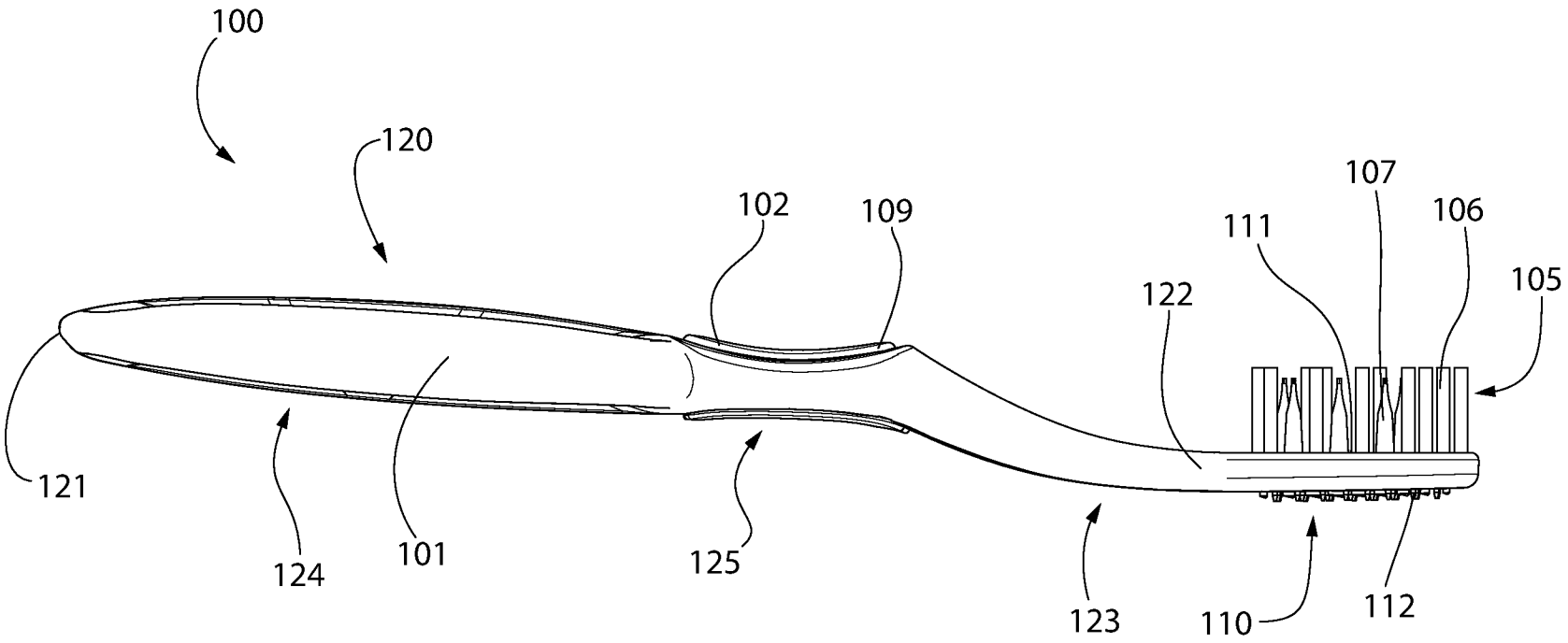
FIG. 4 is a side view of the oral care implement of FIG. 1.

In the exemplified embodiment, the tongue cleaning protrusions 194 comprise a plurality of nubs and a plurality of ridges arranged in alternating arcuate rows along the pad portion 191 (best illustrated in FIG. 3). However, the particular arrangement and style of the tongue cleaning protrusions 194 is not to be limiting of the invention in all embodiments. Thus, in other embodiments the tongue cleaning protrusions 194 could comprise nubs but no ridges, or ridges but no nubs, or some other combination of elements protruding from the rear surface 193 of the pad portion 191 designed to clean that papillae of the tongue.

In the exemplified embodiment, the head portion 180 of the body component 101 comprises a plurality of passageways 183 extending through the thickness of the head portion 180 from the front surface 181 to the rear surface 182. The elastomeric cleaning elements 107 of the elastomeric cleaning element portion 115 of the elastomeric component 102 extend through the passageways 183 in the head portion 180. Specifically, the elastomeric cleaning elements 107 extend from the front surface 192 of the pad portion 191, through the passageways 183 in the head portion 180 of the body component 101, and then protrude from the front surface 111 of the head 110 (which is formed by the front surface 181 of the head portion 180 of the body component 101). The bristle tufts 106 are also illustrated in FIGS. 6 and 7 as being disposed within tuft holes 184 in the head portion 180 of the body component 101. Thus, the elastomeric cleaning elements 107 and the bristle tufts 106 all protrude from the front surface 111 of the head 110 for contact with and cleaning of the teeth and other oral surfaces.

Referring to FIGS. 1 and 7, the elastomeric cleaning elements 107 will be further described. The elastomeric tooth cleaning elements 107 have a cylindrical base portion 170 and a wedge-shaped tip portion 171. The cylindrical base portion 170 tapers as it extends from the front surface 111 of the head 110 towards a distal end 172 of the elastomeric tooth cleaning element 107. The elastomeric cleaning elements 107 taper more significantly along the wedge-shaped tip portion to the distal end 172 to create the wedge shape thereof. The cylindrical base portion 170 maintains a strong base for the elastomeric cleaning elements 107 that minimizes their flexibility slightly, while the wedge-shaped tip portion 171 facilitates a wiping action on the teeth with the elastomeric cleaning elements 107 during use.

Referring briefly to FIGS. 1-3 and 6, the thumb gripping region 125 of the handle 120 comprises an open thumb grip passageway 130. Thus, in its final manufactured state at which point it is ready for packaging and retail sale and/or use by a consumer, there is an aperture formed through the thumb gripping region 125 of the handle 120. The open thumb grip passageway 130 extends from a front opening 131 in an exposed front surface 126 of the handle 120 to a rear opening 132 in an exposed rear surface 127 of the handle 120. The open thumb grip passageway 130 is left as a void space and it is not filled with any material. This results in a reduction in material used to form the oral care implement 100 as compared to conventional oral care implements that do not include such an empty void space. As a user rests his/her thumb on the thumb gripping region 125 of the handle 120, portions of the thumb may extend through the front opening 131 of the open thumb grip passageway 130, depending on how much pressure is being applied by the thumb.

FIG. 1 illustrates the oral care implement 100 in its final assembled and manufactured state in a package 300, which is illustrated generically. Thus, stated another way, FIG. 1 illustrates a packaged oral care implement 1000 that comprises the package 300 and the oral care implement 100 contained in the package 300. The package 300 may be any container, blister pack, box, or the like intended to contain the oral care implement 100 prior to it being opened by a consumer.

Figure 8:
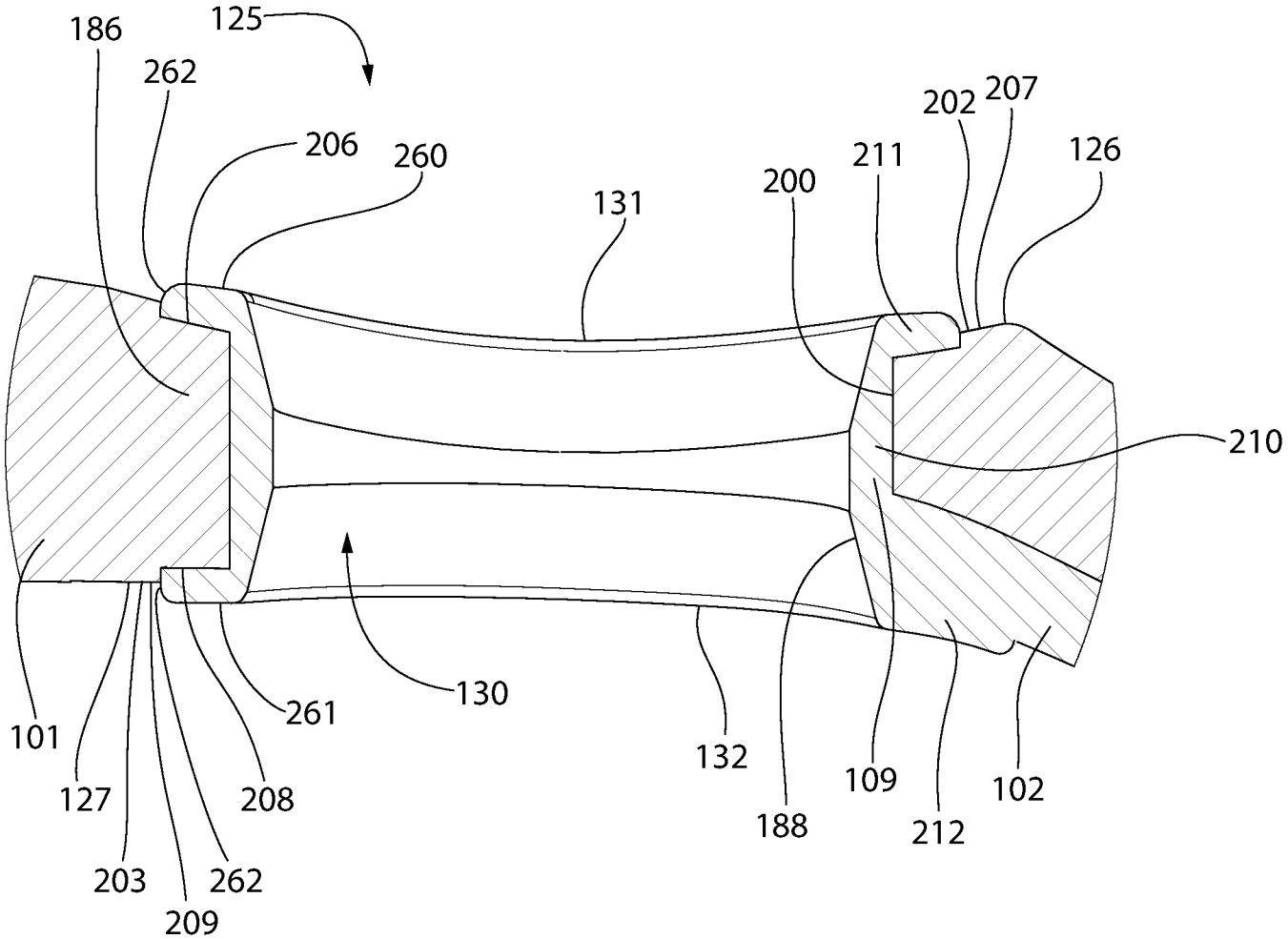
FIG. 8 is a close-up view of area VIII of FIG. 6.
Figure 9:
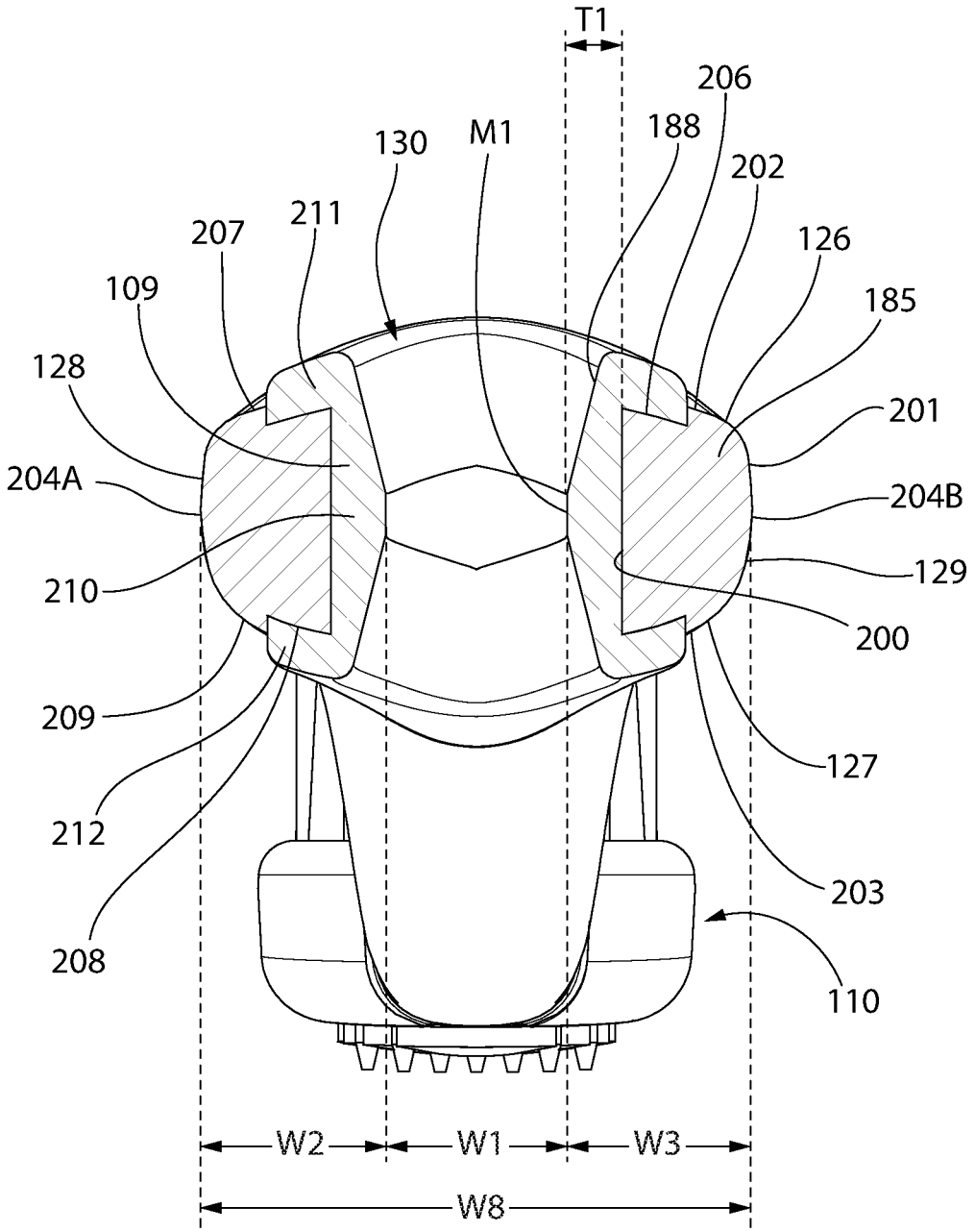
FIG. 9 is a cross-sectional view taken along line IX-IX of FIG. 6.

Referring to FIGS. 6, 8 and 9, the thumb gripping region 125 and the open thumb grip passageway 130 thereof will be further described. The thumb gripping region 125 comprises a ring portion 186 of the handle portion 185 of the body component 101, the elastomeric ring portion 109 of the elastomeric component 102, and the open thumb grip passageway 130 which, as discussed above, extends from the exposed front surface 126 of the handle 120 to the exposed rear surface 127 of the handle 120. As described further below, the elastomeric ring portion 109 of the elastomeric component 102 and the ring portion 186 of the handle portion 185 of the body component 101 both form portions of the exposed front and rear surfaces 126, 127 of the handle 120.

The ring portion 186 of the handle portion 185 of the body component 101 comprises an inner surface 200, an outer surface 201, a front surface 202, and a rear surface 203. The outer surface 201 forms a portion of an exposed left-side surface 204A of the handle 120 and a portion of an exposed right-side surface 204B of the handle 120. Thus, the outer surface 201 of the ring portion 186 of the handle portion 185 of the body component 101 is at least partially exposed (i.e., not covered by the elastomeric component 102 or any other component). The inner surface 200 defines or faces an aperture 205 (see FIG. 5) formed through the body component 101.

The front surface 202 of the ring portion 186 of the handle portion 185 of the body component 101 comprises a recessed portion 206 and an elevated portion 207. Similarly, the rear surface 203 of the ring portion 186 of the handle portion 185 of the body component 101 comprises a recessed portion 208 and an elevated portion 209. The recessed portions 206, 208 may be ring-shaped in some embodiments and they are recessed or sunken relative to the elevated portions 207, 209. The ring-shaped recessed portions 206, 208 are portions of the ring portion 186 of the handle portion 185 of the body component 101 that are immediately adjacent to the inner surface 200. The elevated portions 207, 209 of the ring portion 186 of the handle portion 185 of the body component 101 form portions of the exposed front and rear surfaces 126, 127 of the handle 110 while the recessed portions 206, 208 are covered and therefore not exposed.

The elastomeric ring portion 109 of the elastomeric component 102 is disposed within the aperture 205 of the body component 101. More specifically, the elastomeric ring portion 109 comprises an annular wall portion 210 that abuts against and covers the inner surface 200 of the ring portion 186, a front annular flange 211 that covers or overlies the recessed portion 206 on the front surface 202 of the ring portion 186 of the handle portion 185 of the body component 101, and a rear annular flange 212 that covers or overlies the recessed portion 208 on the rear surface 203 of the ring portion 186 of the handle portion 185 of the body component 101.

The front annular flange 211 of the elastomeric ring portion 109 circumscribes the open thumb grip passageway 130 and forms a portion of the exposed front surface 126 of the handle 120. The rear annular flange 212 of the elastomeric ring portion 109 circumscribes the open thumb grip passageway 130 and forms a portion of the exposed rear surface 127 of the handle 120. Furthermore, the front annular flange 211 of the elastomeric ring portion 109 protrudes from the elevated portion 126 of the ring portion 186 of the handle portion 185 of the body component 101. The rear annular flange 212 of the elastomeric ring portion 109 protrudes from the elevated portion 127 of the ring portion 186 of the handle portion 185 of the body component 101. Stated another way, the front annular flange 211 extends beyond or sticks out past the elevated portion 126 of the ring portion 186 of the handle portion 185 of the body component 101 and the rear annular flange 212 extends beyond or sticks out past the elevated portion 127 of the ring portion 186 of the handle portion 185 of the body component 101. Thus, when a user places his/her thumb on the thumb gripping region 125 of the handle 110, the thumb contacts the elastomeric ring portion 109 before contacting the ring portion 186 of the body component 101 (if it contacts the ring portion 186 of the body component 101 at all). This makes the thumb gripping region 125 soft to the touch to provide a comfortable brushing experience for the user.

Thus, the elastomeric ring portion 109 of the elastomeric component 102 and the ring portion 186 of the body component 101 each form a portion of the exposed front surface 126 of the handle 120 along the thumb gripping region 125 and a portion of the exposed rear surface 127 of the handle 120 along the thumb gripping region 125. The portion of the elastomeric ring portion 109 that forms a portion of the exposed front and rear surface 126, 127 of the handle 120 along the thumb gripping region 125 is elevated relative to (or protrudes from or protrudes relative to) the portion of the ring portion 186 of the body component 101 that forms a portion of the exposed front and rear surfaces 126, 127 of the handle 120 along the thumb gripping region 125.

Due to the elastomeric ring portion 109 of the elastomeric component 102 sticking out past the ring portion 186 of the body component 101, a user's thumb and index finger may only contact the elastomeric ring portion 109 during use, which will enhance the user's comfort during use of the oral care implement 100. The elastomeric ring portion 109 comprises a top surface 260 and a bottom surface 261 that are elevated relative to the elevated portions 207, 209 of the front and rear surfaces 206, 208 of the ring portion 186 of the body component 101 which are immediately adjacent to the elastomeric ring portion 109. Furthermore, the elastomeric ring portion 109 comprises an upper outer surface 262 that extends from the top surface 260 to the elevated portion 207 of the front surface 206 of the ring portion 186 of the body component 101 and a lower outer surface 263 that extends from the bottom surface 261 to the elevated portion 209 of the rear surface 207 of the ring portion 186 of the body component 101.

This structure of the elastomeric ring portion 109 provides some flexibility in that portion 109 of the elastomeric component 102. Thus, as a user manipulates the oral care implement 100, the user can flex and move the portions of the elastomeric ring portion 109 that protrude from the body component 101. This can allow different users to grip the oral care implement 100 in different ways. Specifically, some users may want to force their thumb into the open thumb grip passageway 130 and this can be done by forcing the portions of the elastomeric ring portion 109 that protrude from the body component 101 to flex and increase the size of the front and/or rear openings 131, 132. Other users may gently position their thumb on the elastomeric ring portion 109 without causing it to flex at all.

The elastomeric ring portion 109 has an inner sidewall surface 188 that faces or defines the open thumb grip passageway 130. Thus, the open thumb grip passageway 130 is surrounded and bounded by the inner sidewall surface 188 of the elastomeric ring portion 109. As mentioned above, there is no material in the open thumb grip passageway 130, but rather the open thumb grip passageway 130 remains as a void or empty space after manufacture of the oral care implement 100 is complete. Thus, even when placed in a package for sale, the open thumb grip passageway 130 will remain.

Referring in particular to FIG. 9, a transverse cross-section (taken in a direction transverse to the longitudinal axis A-A of the handle 120) of the thumb gripping region 125 is illustrated. The transverse cross-section is taken along a midpoint of the length of the thumb gripping region 125. The transverse cross-section has a minimum width W1 of the open thumb grip passageway 130, a maximum width W2 of a first sidewall defining the open thumb grip passageway 130, and a maximum width W3 of a second sidewall defining the open thumb grip passageway 130. In the exemplified embodiment, the minimum width W1 of the open thumb grip passageway 130 is substantially equal to or greater than each of the maximum width W2 of the first sidewall and the maximum width W3 of the second sidewall. As used in this context, the term substantially equal includes the minimum width W1 being up to 10% less or 10% more than the maximum widths W2, W3.

As shown in FIG. 9, a thickness T1 of the elastomeric ring portion 109 changes in a direction going from the front surface 126 of the handle 120 to the rear surface 127 of the handle 120. Specifically, in the exemplified embodiment the thickness T1 of the elastomeric ring portion 109 increases from the front surface 126 to a midpoint region M1 of the elastomeric ring portion 109 and then decreases from the midpoint region M1 of the elastomeric ring portion 109 to the rear surface 127. Thus, the width W1 of the open thumb grip passageway 130 decreases from the front opening 131 to the midpoint region M1 and then increases from the midpoint region M1 to the rear opening 132. Stated another way, the width W1 of the open thumb grip passageway 130 increases from the midpoint region M1 to each of the front and rear openings 131, 132 of the open thumb grip passageway 130.

Referring to FIGS. 10-14, the palm gripping region 124 of the handle 120 will be described in greater detail. As noted above, the palm gripping region 124 of the handle 120 is the region of the handle 120 that comprises the proximal end 121 and extends approximately 40%-60% of the length L of the handle 120. Thus, the palm gripping region 124 is the lower-most half (or so) of the handle 120 that is furthest from the head 110.

The palm gripping region 124 of the handle 120 comprises a plurality of elongated slots 220 and a plurality of longitudinal beams 250 that are separated from one another by the plurality of elongated slots 220. More specifically, in the exemplified embodiment the plurality of longitudinal beams 250 comprises a left-side longitudinal beam 251 that comprises a portion of an exposed left-side surface 128 of the handle 120, a right-side longitudinal beam 252 that comprises a portion of an exposed right-side surface of the handle 120, and a middle longitudinal beam 253 disposed between the left-side and right-side longitudinal beams 251, 252. In alternative embodiments, there could be more than one of the middle longitudinal beams 253 each separated from one another by elongated slots as described herein. In the exemplified embodiment, the left-side and right-side longitudinal beams 251, 252 extend along curved beam axes whereas the middle longitudinal beam 253 extends along a linear beam axis.

In the exemplified embodiment, the at least one middle longitudinal beam 253 comprises a central longitudinal beam that extends along the longitudinal axis A-A of the handle 120. Furthermore, the middle longitudinal beam 253 has a maximum width that is greater than the maximum width of each of the left-side and right-side longitudinal beams 251, 252. In that regard, the middle longitudinal beam 253 has a bulbous portion 254 that is centrally located along the length of the middle longitudinal beam 253. The bulbous portion 254 is a widened portion having rounded outer surfaces. In the exemplified embodiment, the middle longitudinal beam 253 extends continuously and unimpeded along the longitudinal axis A-A from a first end to a second end. Stated another way, the middle longitudinal beam 253 extends continuously and unimpeded from the ring portion 186 of the handle portion 185 of the body component 101 in the thumb gripping region 125 to the proximal end 121 (or an area adjacent to the proximal end 121) of the handle 120. Thus, the middle longitudinal beam 253 is a continuously extending structure that is integral with and forms a part of the body component 101. Top and bottom surfaces of the middle longitudinal beam 253 form unbroken and continuous portions of the exposed front and rear surfaces 126, 127 of the handle 120.

The plurality of elongated slots 220 comprises a first elongated slot 221 located between the left-side longitudinal beam 251 and the middle longitudinal beam 253 and a second elongated slot 222 located between the right-side longitudinal beam 253 and the middle longitudinal beam 253. The first and second elongated slots 221, 222 are regions of the handle 120 that are devoid of any material. Thus, the slots 221, 222 are the result of a dearth of material in the spaces between the adjacent longitudinal beams 250. An inner surface 265 of the left-side longitudinal beam 251 and a first surface 266 of the middle longitudinal beam 253 forms walls of the first elongated slot 221. An inner surface 267 of the right-side longitudinal beam 251 and a second surface 268 of the middle longitudinal beam 253 form walls of the second elongated slot 222.

The first elongated slot 221 defines a first open slot passageway 223 extending from the exposed front surface 126 of the handle 120 to the exposed rear surface 127 of the handle 120. The first elongated slot 221 extends from a first slot end 224 to a second slot end 225 along a first longitudinal slot axis B-B. The first elongated slot 221 comprises a floor 228, a first slot portion 229 extending from the exposed front surface 126 of the handle 120 to the floor 228, and a second slot portion 230 extending from the exposed rear surface 127 of the handle 120 to the floor 228. In the exemplified embodiment, the floor 228 comprises a first transverse floor portion 226 extending between the left-side longitudinal beam 251 and the middle longitudinal beam 253 at or adjacent to the first slot end 224 and a second transverse floor portion 227 extending between the left-side longitudinal beam 251 and the middle longitudinal beam 253 at or adjacent to the second slot end 225. The first and second transverse floors portions 226, 227 may be connected to one another (i.e., the floor 228 may extend continuously from the first slot end 224 to the second slot end 225) or they may be completely separated.

Furthermore, in the exemplified embodiment there is a first aperture 231 formed into the floor 228 of the first elongated slot 221. The first aperture 231 forms a passageway from the first slot portion 229 of the first elongated slot 221 to the second slot portion 230 of the first elongated slot 221. Due to the existence of the first aperture 231, the first open slot passageway 223 is formed that extends continuously from the exposed front surface 126 to the exposed rear surface 127 of the handle 120. Specifically, there is a passageway (the first open slot passageway 223) that exists through the palm gripping section 124 of the handle 120 along at least a portion of the first elongated slot 221. The first aperture 231 extends continuously and unimpeded from a first end to a second end in a direction of the first slot axis B-B.

The second elongated slot 222 defines a second open slot passageway 232 extending from the exposed front surface 126 of the handle 120 to the exposed rear surface 127 of the handle 120. The second elongated slot 222 extends from a first slot end 233 to a second slot end 234 along a second longitudinal slot axis C-C. The second elongated slot 222 comprises a floor 235, a first slot portion 236 extending from the exposed front surface 126 of the handle 120 to the floor 235, and a second slot portion 237 extending from the exposed rear surface 127 of the handle 120 to the floor 235. In the exemplified embodiment, the floor 235 comprises a first transverse floor portion 238 extending between the right-side longitudinal beam 252 and the middle longitudinal beam 253 at or adjacent to the first slot end 233 and a second transverse floor portion 239 extending between the right-side longitudinal beam 252 and the middle longitudinal beam 253 at or adjacent to the second slot end 234. The first and second transverse floors portions 238, 239 may be connected to one another (i.e., the floor 235 may extend continuously from the first slot end 233 to the second slot end 234) or they may be completely separated.

Furthermore, in the exemplified embodiment there is a second aperture 240 formed into the floor 235 of the second elongated slot 222. The second aperture 240 forms a passageway from the first slot portion 236 of the second elongated slot 222 to the second slot portion 237 of the second elongated slot 222. Due to the existence of the second aperture 240, the second open slot passageway 232 is formed that extends continuously from the exposed front surface 126 to the exposed rear surface 127 of the handle 120. Specifically, there is a passageway (the second open slot passageway 232) that exists through the palm gripping section 124 of the handle 120 along at least a portion of the second elongated slot 222. The second aperture 240 extends continuously and unimpeded from a first end to a second end in a direction of the second slot axis C-C.

Figure 10:
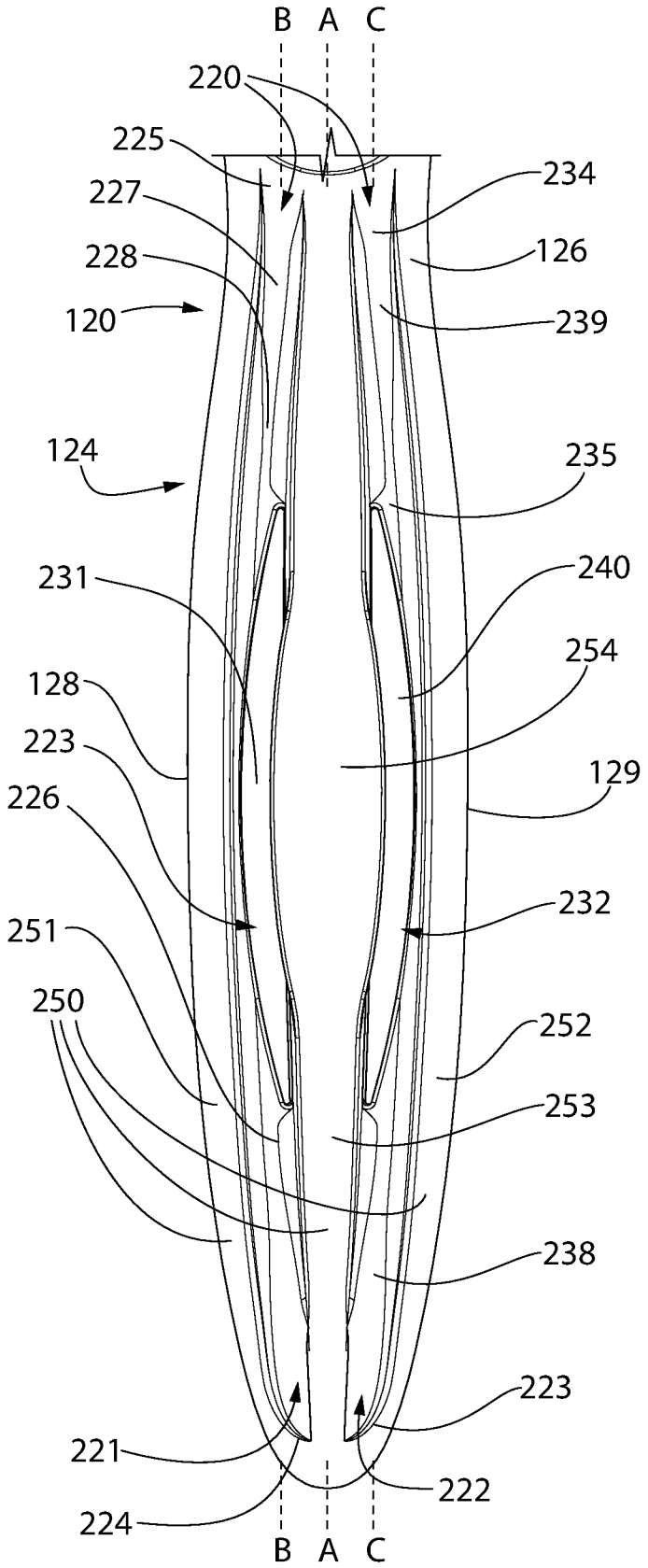
FIG. 10 is a close-up view of area X of FIG. 2.

As best seen in FIG. 10, in the exemplified embodiment each of the first and second apertures 231, 240 are arcuate shaped. More specifically, the first and second apertures 231, 240 have an arcuate shape with concave surfaces thereof facing one another. The first and second apertures 231, 240 could be modified to have different shapes in alternative embodiments, such as being rectangular, triangular, wavy-shaped, or the like as may be desired. The first and second apertures 231, 240 are elongated in a direction of the longitudinal axis A-A of the handle 120. In the exemplified embodiment, the first and second apertures 231, 240 extend for somewhere between 40% and 60% of the length of the first and second elongated slots 221, 222, respectively. However, the lengths of the first and second apertures 231, 240 could be increased to further decrease the amount of plastic used to form the oral care implement 100 or decreased if needed to increase structural integrity of the oral care implement 100. The first and second apertures 231, 240 are aligned with one another in the exemplified embodiment.

Figure 11:
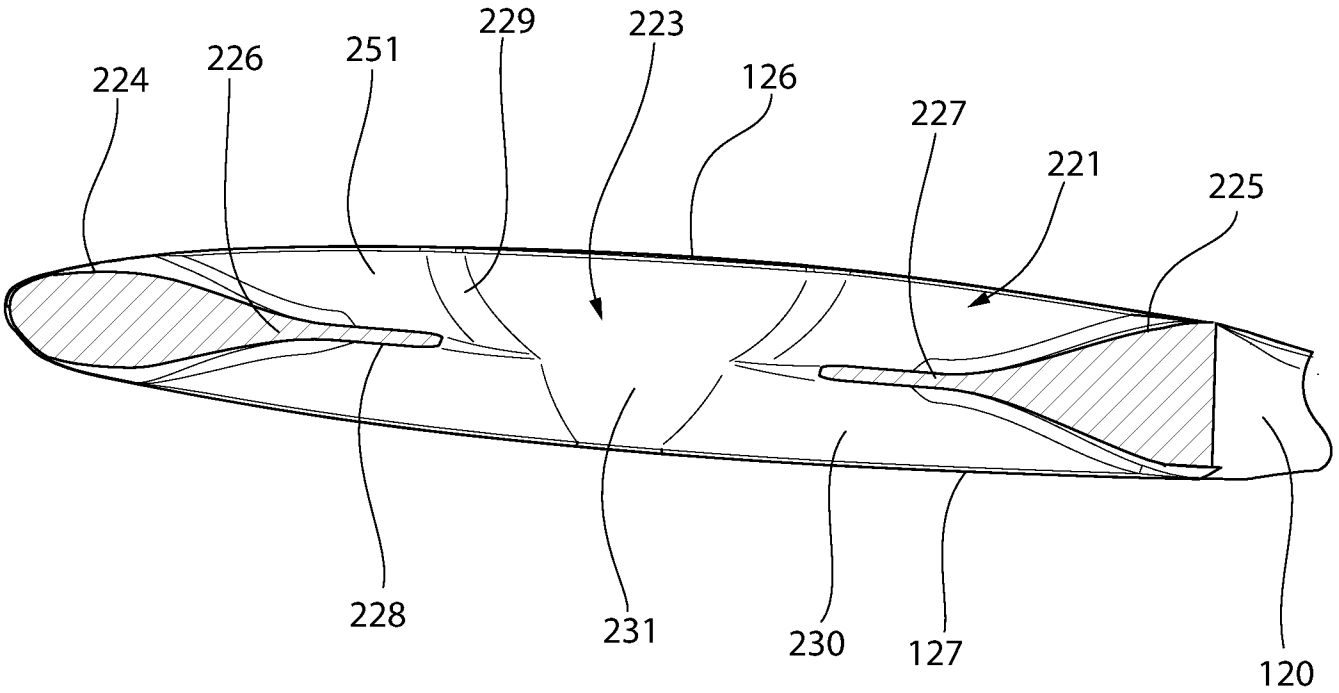
FIG. 11 is a cross-sectional view taken along line XI-XI of FIG. 2.

As best seen in FIG. 11, a height of the floor 228 increases with distance from the first aperture 231 towards the first and second slot ends 224, 225 of the first elongated slot 221. The height of the floor 235 similarly increases with distance from the aperture 240 towards the first and second slot ends 233, 234 of the second elongated slot 222. Thus, stated another way, the floor 228 of the first elongated slot 221 forms a ramp surface adjacent opposing ends of the aperture 231 and the floor 235 of the second elongated slot 222 forms a ramp surface adjacent opposing ends of the aperture 240. Ramping or sloping the surfaces of the floors 228, 235 on opposing ends of the apertures 231, 240 creates a path for water to travel while rinsing to prevent toothpaste and bacteria from building up in the region of the elongated longitudinal slots 220.

Figure 12:
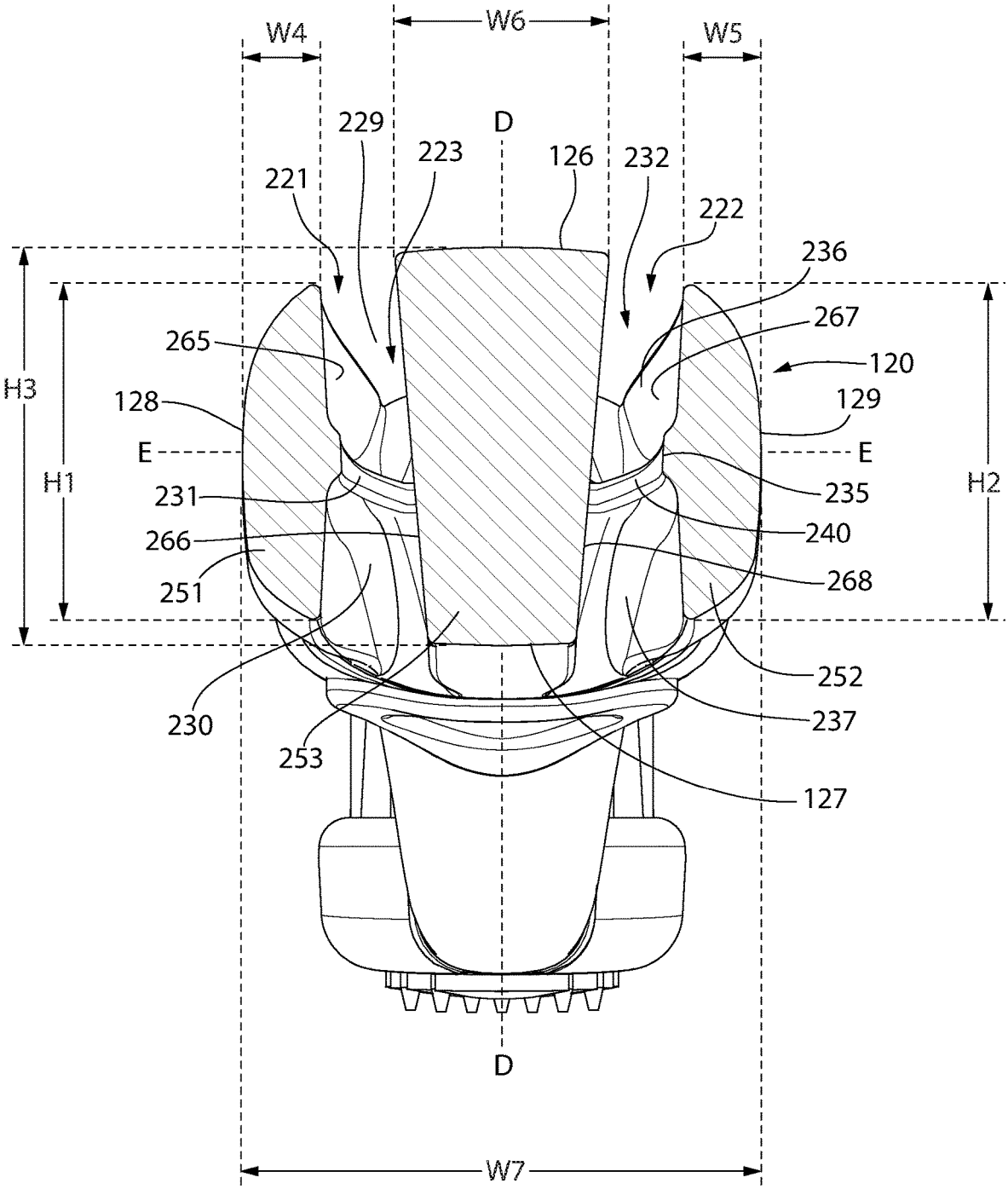
FIG. 12 is a cross-sectional view taken along line XII-XII of FIG. 2.
Figure 13:
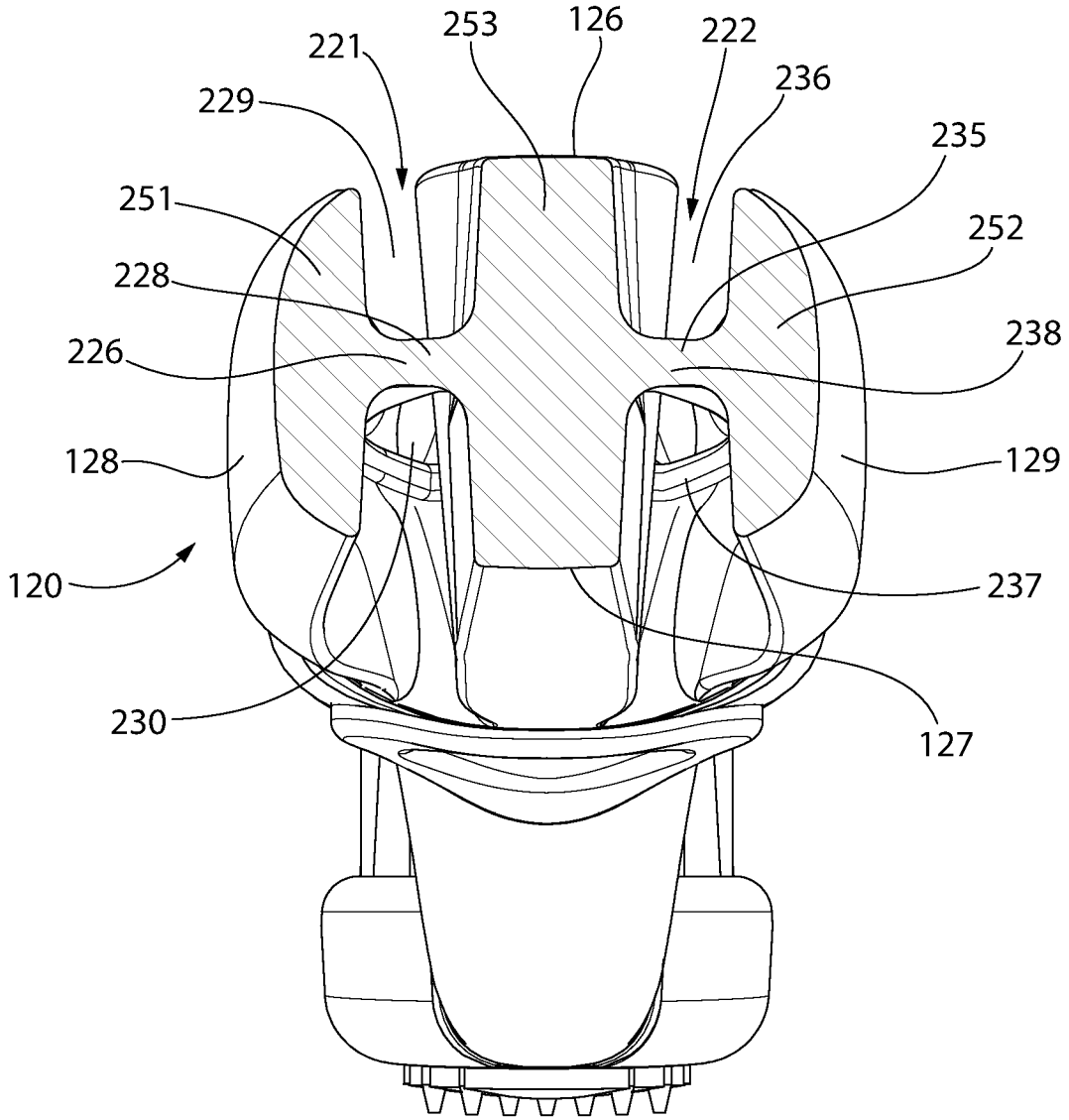
FIG. 13 is a cross-sectional view taken along line XIII-XIII of FIG. 2.
Figure 14:
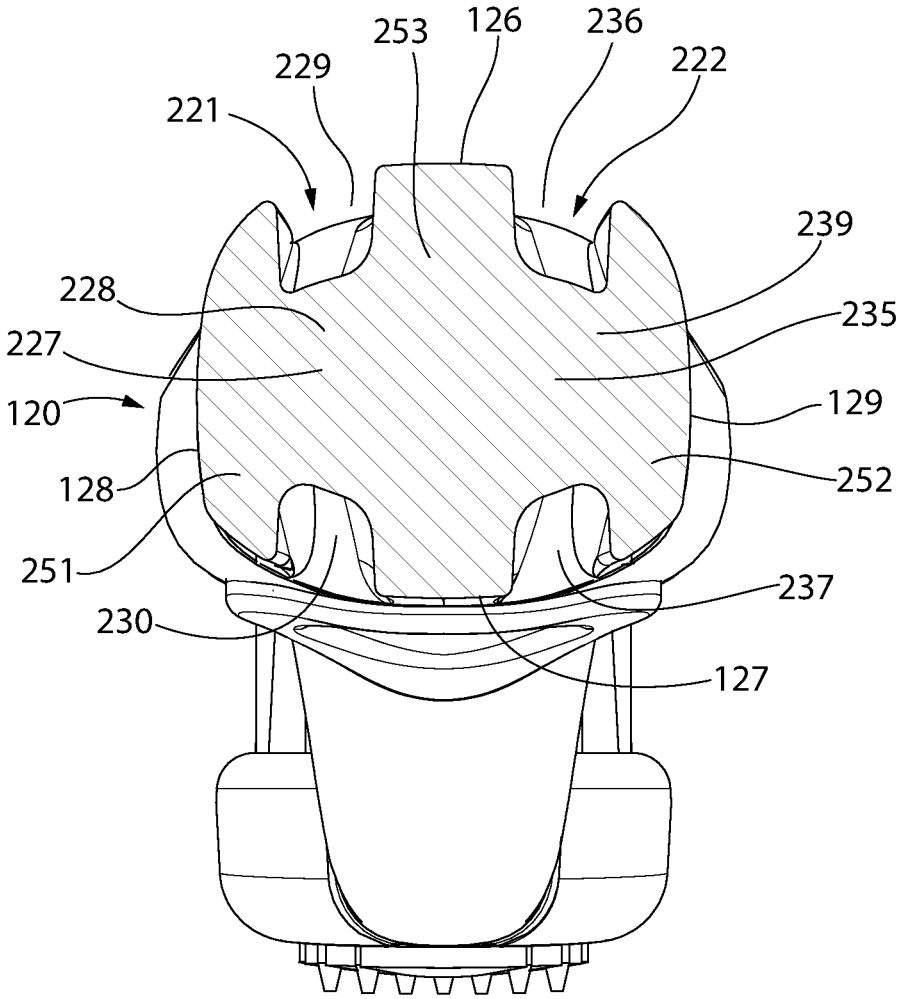
FIG. 14 is a cross-sectional view taken along line XIV-XIV of FIG. 2.

Referring to FIG. 12, a transverse cross-section of the longitudinal beams 251, 252, 253 is depicted. As shown, the left-side longitudinal beam 251 has a maximum height H1, measured along a height axis D-D that extends from the exposed front surface 126 of the handle 120 to the exposed rear surface 127 of the handle 120. The left-side longitudinal beam 251 also has a maximum width W4, measured along a width axis E-E that is perpendicular to the height axis. The maximum height H1 of the left-side longitudinal beam 251 is greater than the maximum width W4 of the left-side longitudinal beam 251. The right-side longitudinal beam 252 has a maximum height H2 measured along the height axis D-D and a maximum width W5 measured along the width axis E-E. The maximum height H2 of the right-side longitudinal beam 252 is greater than the maximum width W5 of the right-side longitudinal beam 252. The middle longitudinal beam 253 has a maximum height H3 measured along the height axis D-D and a maximum width W6 measured along the width axis E-E. The maximum height H3 of the middle longitudinal beam 253 is greater than the maximum width W6 of the middle longitudinal beam 253. Furthermore, the maximum height H3 of the middle longitudinal beam 253 is greater than the maximum heights H1, H2 of each of the left-side and right-side longitudinal beams 251, 252. The maximum width W6 of the middle longitudinal beam 253 is also greater than the maximum widths W4, W5 of the left-side and right-side longitudinal beams 251, 252. The first and second elongated slots 221, 222 may have maximum widths that are greater than the maximum widths W4, W5 of the left-side and right-side longitudinal beams 251, 252 but less than the maximum width W6 of the middle longitudinal beam 253.

Figure 2:
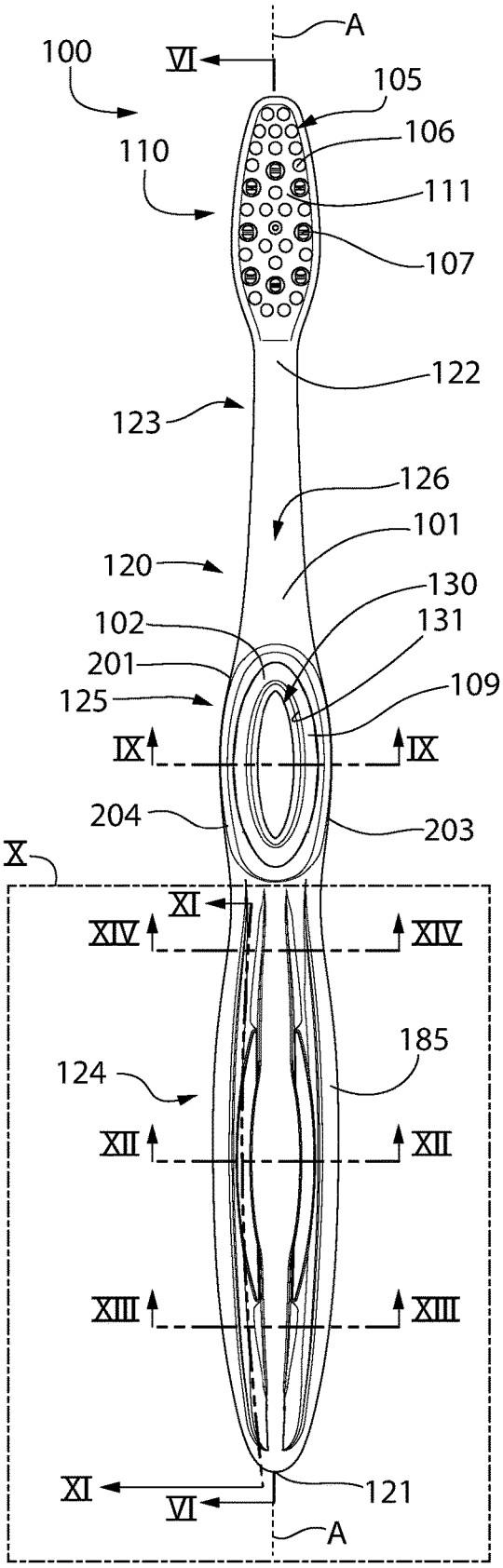
FIG. 2 is a front view of the oral care implement of FIG. 1.

Referring to FIGS. 2, 9, and 10, in the exemplified embodiment, the palm gripping region 124 has a maximum width W7 measured from the exposed left-side surface 128 of the handle 120 to the exposed right-side surface 129 of the handle 120, with the maximum width W7 of the palm gripping region 124 being the maximum width of the handle 120. The thumb gripping region 125 also has a maximum width W8 measured from the exposed left-side surface 128 of the handle to the exposed right-side surface 129 of the handle 120. The maximum width W7 may be greater than the maximum width W8. Furthermore, the handle 120 may comprise a narrowed waist 126 at the juncture of the thumb gripping region 125 and the palm gripping region 124. The narrowed waist 167 may comprise a maximum width W9 measured between the exposed left-side surface 128 of the handle 120 and the exposed right-side surface 129 of the handle 120 such that the maximum width W9 of the narrowed waist 167 may be less than the maximum width W7 of the palm gripping region 124 and the maximum width W8 of the thumb gripping region 125.

As noted above, one purpose in the structure and of the oral care implement 100 is to reduce the total amount of plastic being used to form the oral care implement 100 while still ensuring that the oral care implement 100 has structural integrity and will withstand the wear and tear associated with normal use. In that regard, in some embodiments the oral care implement 100 may have a material volume, which is a volume of all of the materials used to form the oral care implement. In some embodiments, the material volume may be in a range of 13 $cm^3$ to 16 $cm^3$, or more specifically 14 $cm^3$ to 15 $cm^3$, and still more specifically 14 $cm^3$ to 14.5 cm3. The handle 120 of the oral care implement 100 may have a material volume in a range of 10 $cm^3$ to 15 cm3, and more specifically 12 $cm^3$ to 14 $cm^3$. The oral care implement 100 may also have a void volume, with is the volume of all of the void spaces of the oral care implement including the open thumb grip passageway 130 and the first and second elongated slots 221, 222. Thus, the plurality of voids that make up the void volume includes the open thumb grip passageway 130 and the first and second elongated slots 221, 222 in the exemplified embodiment. In some embodiments, the void volume may be in a range of 3 $cm^3$ to 6 $cm^3$, more specifically 4 $cm^3$ to 5 $cm^3$, and still more specifically 4 $cm^3$ to 4.5 $cm^3$. The void volume of the oral care implement 100 is also the void volume of the handle 120 of the oral care implement.

In some embodiments a ratio of the void volume of the oral care implement 100 to a material volume of the oral care implement 100 is greater than 0.25:1. In some embodiments a ratio of the void volume of the oral care implement 100 to the material volume of the oral care implement 100 is in a range of 0.25:1 to 0.5:1, or 0.25:1 to 0.4:1, or 0.3:1 to 0.5:1. In some embodiments, a ratio of the void volume of the handle 120 to the material volume of the handle 120 may be greater than 0.3:1, or may be in a range of 0.33:1 to 0.4:1. In some embodiments, the difference between leaving the void spaces empty and filling them in with plastic results in a reduction in the weight of the oral care implement 100 of approximately 25%, or between 25% and 35%.

The invention has been described herein above whereby the oral care implement 100 includes a body component 101 and an elastomeric component 102. However, in alternative embodiments the elastomeric component 102 may be omitted and the oral care implement 100 may not include any elastomeric materials. Thus, the elastomeric connector portion 116 and the elastomeric cleaning element portion 115 may be omitted in some embodiments (although the oral care implement 100 may still include a tongue or soft tissue cleanser formed from a rigid material). Moreover, in such embodiments the ring portion 109 of the elastomeric component 102 may simply be a ring component 199 (labeled only in FIGS. 2 and 3) without regard to its material of construction. The ring component 199 as described herein is intended to be identical in structure to the ring portion 109 of the elastomeric component 102 described herein. However, the term ring component 199 is intended to capture the structure of the ring portion 109 and its interaction with the body component 101 regardless of its material of construction.

Specifically, the thumb gripping region 125 of the handle 102 may comprise the ring portion 186 of the body component 101 formed of a first material and the ring component 199 formed of a second material. The ring component 199 may be identical in structure to the ring portion 109 of the elastomeric component 102, but possibly different in terms of material of construction. In such embodiments, the first material and the second material may be different from one another in at least one characteristic. In some embodiments, the characteristics may be selected from color, texture, elasticity, and rigidity (i.e., hardness).

Thus, in some embodiments the ring portion 186 of the body component 101 may be formed of a hard plastic such as polypropylene and the ring component 199 may be formed of an elastomeric component (which is the case in the embodiment described in detail above). In other embodiments, the ring portion 186 of the body component 101 may be formed of a hard plastic and the ring component 199 may also be formed of a hard plastic. In some embodiments, the ring portion 186 of the body component 101 and the ring component 199 may be formed of the same hard plastic material. In such embodiments, the ring portion 186 of the body component 101 and the ring component 199 may differ based on characteristics other than material of construction, such as color or texture, for example. In some embodiments, the ring portion 186 of the body component 101 may comprises a first color and the ring component 199 may comprises a second color. In some embodiments the ring portion 186 of the body component 101 may be formed from a first shot during an injection molding process and the ring component 199 may be formed from a second shot during the injection molding process, with the ring component 199 being injection molded onto the ring portion 186 of the body component 101. The ring component 199 is disposed within the aperture 205 in the ring portion 185 of the body component 101 of the thumb gripping region 125 and the ring component 199 defines or otherwise surrounds the open thumb grip passageway 130.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head;

a plurality of tooth cleaning elements extending from an exposed front surface of the head;

a handle extending along a longitudinal axis from a proximal end to a distal end, the head coupled to the distal end of the handle, the handle comprising:

a neck region comprising the distal end;

a palm gripping region comprising the proximal end; and a thumb gripping region located between the neck and palm gripping regions, the thumb gripping region comprising a ring portion of a body component formed of a first material, a ring portion of a second component formed of a second material coupled to the ring portion of the body component, and an open thumb gripping passageway extending through the ring portion of the second component from an exposed front surface of the handle to an exposed rear surface of the handle, the ring portion of the second component forming a portion of the exposed front surface and the exposed rear surface; and wherein the ring portion of the second component and the body component of the thumb gripping region both form portions of an exposed outer surface of the handle;

wherein the ring portion of the second component comprises a front annular flange forming a portion of the exposed front surface of the handle and circumscribing the open thumb grip passageway and a rear annular flange forming a portion of the exposed rear surface of the handle and circumscribing the open thumb grip passageway; and wherein the ring portion of the second component further comprises a connector portion that extends along the neck region to connect the ring portion of the second component to the plurality of tooth cleaning elements.

2. The oral care implement according claim 1 wherein the ring portion of the second component of the thumb gripping region of the handle comprises one or more inner sidewall surfaces that define the open thumb grip passageway.

3. The oral care implement according to claim 1 wherein the ring portion of the second component comprises a front annular flange forming a portion of the exposed front surface of the handle and circumscribing the open thumb grip passageway and a rear annular flange forming a portion of the exposed rear surface of the handle and circumscribing the open thumb grip passageway.

4. The oral care implement according to claim 1 wherein the ring portion of the body component comprises an inner surface, an outer surface that forms a portion of an exposed left-side surface of the handle and a portion of an exposed right-side surface of the handle, a front surface that forms a portion of the exposed front surface of the handle, and a rear surface that forms a portion of the exposed rear surface of the handle.

5. The oral care implement according to claim 4 wherein the ring portion of the second component covers an entirety of the inner surface of the ring portion of the body component, a portion of the front surface of the ring portion of the body component, and a portion of the rear surface of the ring portion of the body component.

6. The oral care implement according to claim 1 wherein the ring portion of the body component comprises a front surface that forms a first portion of the exposed front surface of the handle along the thumb gripping region and the ring portion of the second component comprises a front surface that forms a second portion of the exposed front surface of the handle along the thumb gripping region, the second portion of the exposed front surface of the handle being elevated relative to the first portion of the exposed front surface of the handle.

7. The oral care implement according to claim 6 wherein the ring portion of the body component comprises a rear surface that forms a first portion of the exposed rear surface of the handle along the thumb gripping region and the ring portion of the second component comprises a rear surface that forms a second portion of the exposed rear surface of the handle along the thumb gripping region, the second portion of the exposed rear surface of the handle being elevated relative to the first portion of the exposed rear surface of the handle.

8. The oral care implement according to claim 1 wherein the ring portion of the second component protrudes from a front surface and a rear surface of the ring portion of the body component.

9. The oral care implement according to claim 1 wherein the open thumb gripping passageway extends from a front opening in the exposed front surface of the handle to a rear opening in the exposed rear surface of the handle, and wherein the open thumb gripping passageway is not filled in with any material so that the open thumb gripping passageway is left as a void space in the handle.

* * * * *